US006081947A

United States Patent [19]

Disher

[11] Patent Number: 6,081,947

[45] Date of Patent: Jul. 4, 2000

[54] MASSAGE BOARD AND FACE REST

[76] Inventor: Michael J. Disher, 713 Sweet Water Dr., Danville, Calif. 94506-1225

[21] Appl. No.: 09/059,138

[22] Filed: Apr. 13, 1998

[51] Int. Cl.[7] ..... A47C 20/00

[52] U.S. Cl. ..... 5/632; 5/638; 248/118.3; 248/125.8

[58] Field of Search ..... 248/118, 118.3, 248/122.1, 125.8, 185.1; 5/636, 638, 652.1, 661, 622

[56] References Cited

U.S. PATENT DOCUMENTS

| | | | |
|---|---|---|---|
| 2,398,940 | 4/1946 | Jones | 5/636 |
| 2,507,172 | 5/1950 | Naclerio | 5/636 |
| 2,579,783 | 12/1951 | Branto | 5/636 |
| 2,688,142 | 9/1954 | Jensen | 5/638 |
| 3,608,103 | 9/1971 | Seid . | |
| 4,710,991 | 12/1987 | Wilmore et al. | 5/638 |
| 4,752,064 | 6/1988 | Voss . | |
| 5,147,287 | 9/1992 | Jewell et al. . | |
| 5,177,823 | 1/1993 | Riach . | |
| 5,233,713 | 8/1993 | Murphy et al. . | |
| 5,317,771 | 6/1994 | Cook . | |
| 5,327,665 | 7/1994 | Manning et al. | 248/122.1 |
| 5,427,436 | 6/1995 | Lloyd . | |

*Primary Examiner*—Terry Lee Melius
*Assistant Examiner*—James M. Hewitt
*Attorney, Agent, or Firm*—Morriss, Bateman, O'Bryant & Compagni

[57] ABSTRACT

A device for use in providing or receiving massage therapy at home or in the office comprises a portable face rest attached to a support for positioning the device on a supporting surface, such as a bed, table or floor. The face rest may be adjustable relative to the support to selectively adjust the face rest to accommodate individual users. The face rest may be attached to the support in a manner which allows the face rest to be adjusted at an angle to the support. The device may also include arm rests for optionally supporting the massage recipient's arms during massage therapy.

15 Claims, 4 Drawing Sheets

MASSAGE BOARD AND FACE REST

BACKGROUND OF THE INVENTION

1. Field of the Invention

This invention relates to devices used in the rendering of massages and similar therapies to a person, and specifically relates to a portable, adjustable massage board and associated face rest for supporting the face and head of a person receiving a massage.

2. Description of Related Art

There has been a steady and growing increase in providing and receiving massage therapy and related types of body relaxation techniques, due in part to an increase in stress resulting from frenetic lifestyles and increased participation in strenuous recreational activities. The increase in interest in massage therapy has seen a concomitant increase in the number of massage therapists and an increase in massage salons or similar businesses where people can go to receive a massage. However, at the same time, there has been an increased interest in receiving massage therapy in the familiar surroundings of one's home or office, provided by either a professional massage therapist, a family member or a friend.

Massage therapy provided outside a professional massage or beauty salon typically employs crude methods of positioning the massage recipient. For example, when obtaining a massage at work, the recipient may remain seated in a chair or may position his head pronately on a desk cushioned by the forearms. While such makeshift positions will do, it does not provide the best accommodations for either the massage recipient or massage provider in terms of conveniently reaching the recipient or permitting the recipient to relax his head, neck and back during the massage. Conditions in the home are generally no more suitable than the office for providing massage therapy. Lying pronately on a bed or couch does not provide the best arrangement for either the massage recipient or massage giver because the massage giver has difficulty reaching the neck and back of the recipient, and the recipient must rotate his head to one side or the other in order to be able to breath.

Thus, it would be advantageous to provide an adjustable structure for positioning and supporting the head, neck and shoulders of the massage recipient in a manner that is comfortable for the recipient and which allows the recipient to breath unobstructedly. It would further be advantageous to provide an adjustable structure which positions the massage recipient in a manner which is convenient for the massage giver to reach the recipient, and it would be advantageous to provide such a structure which is portable and sized for storage.

BRIEF SUMMARY OF THE INVENTION

In accordance with the present invention, a face rest is provided for supporting the pronately-positioned head of a person while receiving massage therapy. The face rest may be adjustable for the comfort of the user in positioning and supporting his head during the massage. The invention is portable and easily stored in the home, office or other location where a massage may be provided. The face rest is connected to, and adjustable relative to, a support which maintains the face rest in position relative to the person's body.

The face rest of the invention is generally formed with a base frame having an aperture formed therethrough which is sized for receiving the forward aspect of a person's face. A cushion member surrounds the aperture to provide a pliant support for the face of the user. The base frame of the face rest is connected to a support which anchors the face rest in a given place or position. In one embodiment, the support may be a padded, elongated platform member sized to support the upper portion of a person's body, from the shoulders to at least the abdomen. The first embodiment of the invention is particularly suitable for use on a bed or other substantially flat surface upon which the massage recipient may recline in a prone position. The face rest may be adjustable relative to the elongated platform member so that the face rest is positioned an appropriate distance from the elongated platform member corresponding to the distance between the user's shoulders and head. Thus, the face rest can be adjusted to accommodate any user.

In an alternative embodiment, the face rest is attached to a stand having a base for supporting the stand on the floor or other horizontal surface. The stand may preferably be longitudinally adjustable to raise or lower the face rest relative to the horizontal support surface. The face rest may also be adjustable relative to the stand to modify the angle at which the face rest is inclined. The adjustability of the face rest relative to the stand allows the massage recipient to be positioned in a variety of reclining and seated positions. The face rest may be further structured with selectively positionable hand or arm rests to supplement the comfort of the user. In use, the arm rests can be moved from a storage position to a second position near face rest so that the user can rest his hands or arms on either side of his head during the massage.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
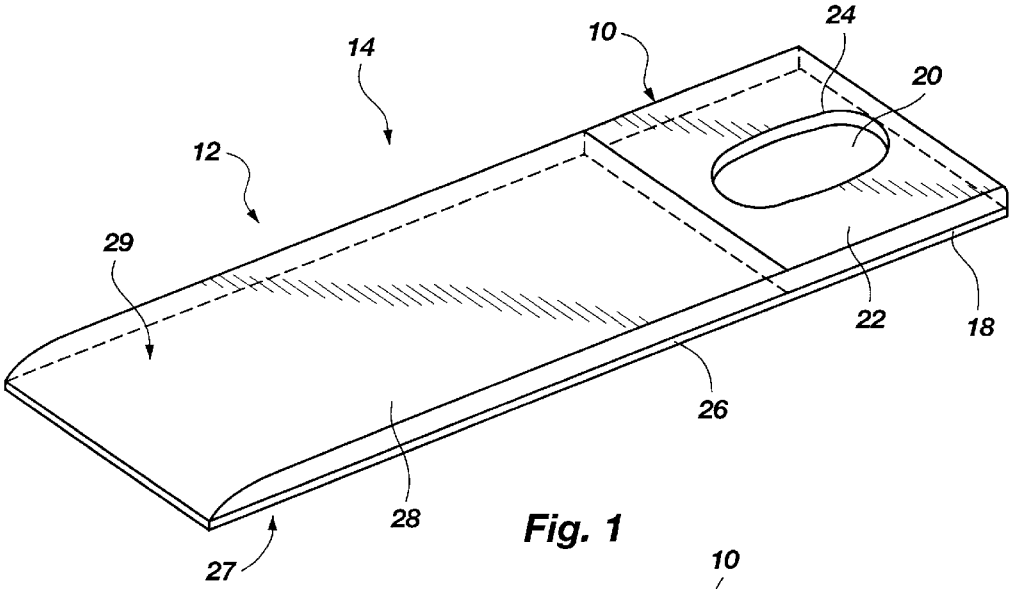
FIG. 1 is a perspective view of a first embodiment of the invention.

The basic structure of the present invention is illustrated in FIG. 1 where a face rest 10 is attached to a support 12 to form a massage board 14 member. The face rest 10 may be formed from a base frame 18, such as board, which imparts structural strength to the face rest 10. Alternatively, the base frame 18 may be non-planar or curved. The base frame 18 has an aperture 20 formed therethrough which is sized to receive the forward aspect of a person's face (i.e., the nose, chin and cheeks). A cushioned member 22 is positioned on the base frame 18 and about the aperture 20 to provide a pliant margin 24 about the aperture 20. The pliant margin 24 formed by the cushioned member 22 is sized to receive and cushion the peripheral edge of a person's face when reclined in a prone position on the massage board 14.

In the embodiment shown in FIG. 1, the face rest 10 may be attached to the support 12 such that the base frame 18 of the face rest 10 is contiguous with an elongated platform member 26 which extends away from the face rest 10. The elongated platform member 26 comprises an undersurface 27 for placement on a supporting surface, such as a bed, table or floor, and may also have a cushioned member 28 positioned against an upper surface 29 of the elongated platform member 26 upon which the user reclines for receiving a massage, as similarly shown in FIG. 3. The cushioned member 28 of the elongated platform member 26 is provided for the comfort of the user in reclining on the massage board 14 and may be optional.

Figure 2:
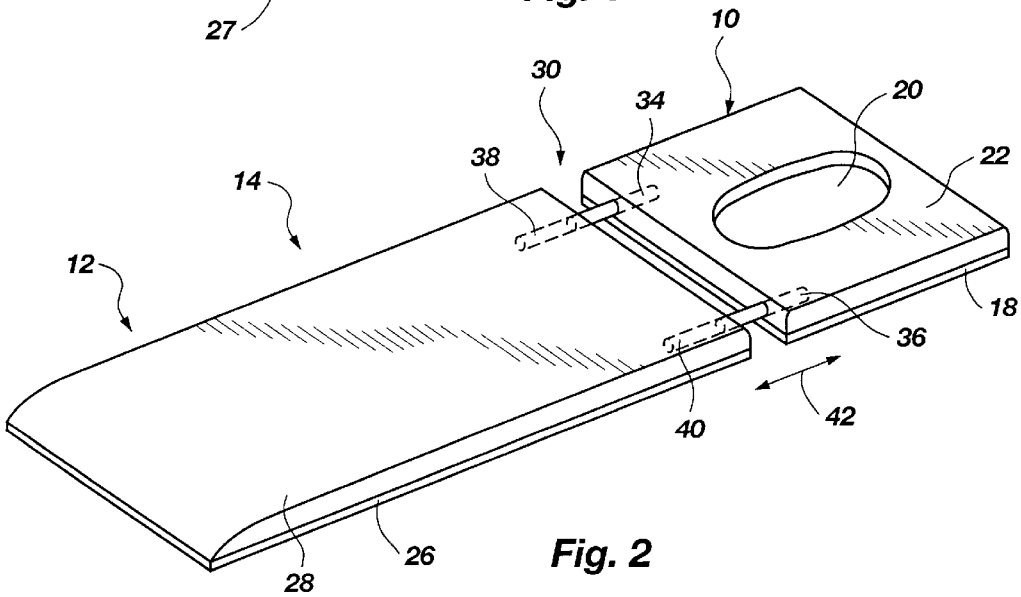
FIG. 2 is a perspective view of the embodiment shown in FIG. 1 illustrating the face rest adjusted relative to the elongated platform member.
Figure 3:
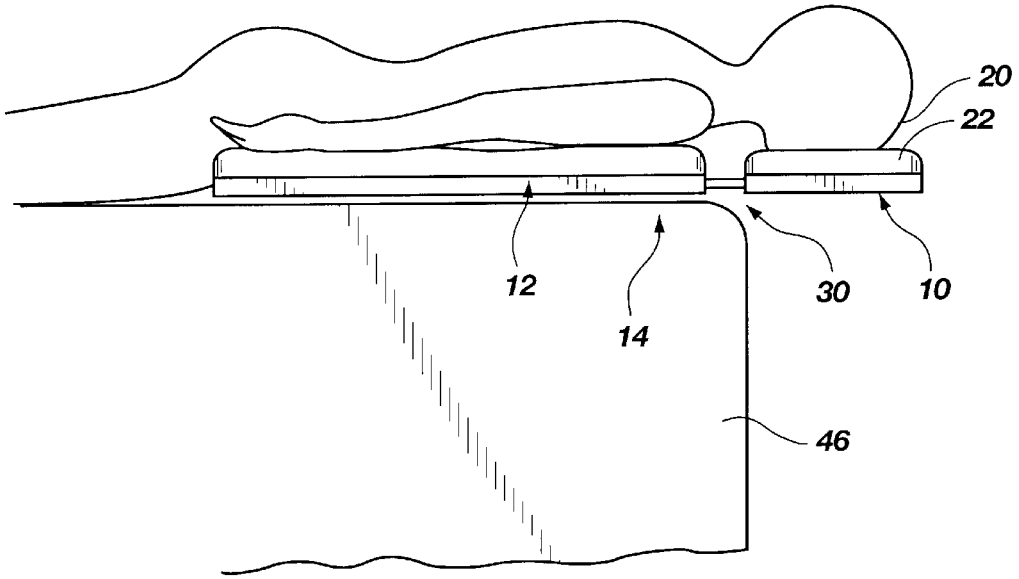
FIG. 3 is a side view in elevation of the embodiment shown in FIG. 2 demonstrating its use.

In an alternative embodiment shown in FIGS. 2 and 3, the face rest 10 is longitudinally adjustable relative to the support 12 by adjustment apparatus 30. The adjustment apparatus 30 shown here, by way of example only, comprises two stabilizing rods 34, 36 which are embedded in or integrally formed with the base frame 18 of the face rest 10. The stabilizing rods 34, 36 are sized to be slidably received into correspondingly numbered and sized tubular openings 38, 40 formed in the elongated platform member 26 of the support 12. While two stabilizing rods 34, 36 are shown, one stabilizing rod may be sufficient. Thus, the face rest 10 may be selectively adjusted, in the directions of arrow 42, relative to the support 12 to enable the face rest 10 to be finely adjusted to the body proportions of the user. Any other suitable adjustment apparatus may be employed which provides longitudinal movement of the face rest 10 relative to the support 12.

As shown in FIG. 3, the massage board of FIG. 2 may, most suitably, be positioned on the edge of a bed 46 with the face rest 10 portion of the massage board 14 extending over the edge of the bed 46. The user may then recline in a prone position, as shown, with the upper portion of the body being positioned on the support 12 and the forward aspects of the face being positioned in the aperture 20 of the face rest 10. Alternatively, the user may recline in a supine position with the back of the head being supported by the cushioned member 22 surrounding the aperture 20.

Figure 4:
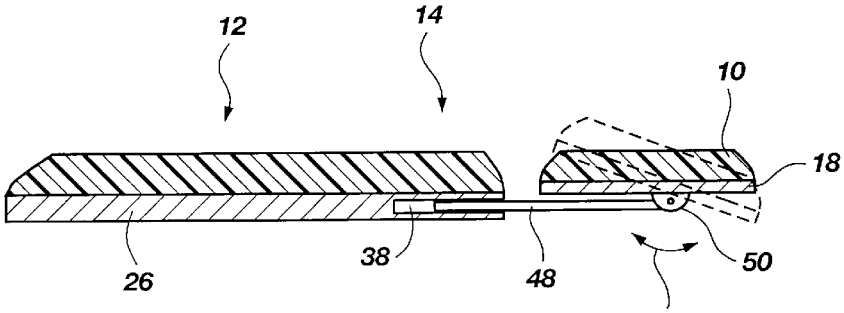
FIG. 4 is a view in longitudinal cross section of an alternative embodiment of the invention shown in FIG. 2 where the face rest is adjustably rotatable.

In another alternative embodiment of the invention, shown in FIG. 4, the face rest 10 may be structured with one or more stabilizing rods 48 which are sized to be slidably received into one or more correspondingly sized and numbered openings 38 formed in the elongated platform member 26 of the support 12. The stabilizing rod 48 may, however, extend along the base frame 18 of the face rest 10 and be pivotally connected to a saddle bracket 50, or similar device, which is connected to the base frame 18 of face rest 10 such that the face rest 18 may rotate about the pivot of the saddle bracket 50, as suggested by arrow 52, and as suggested in phantom. The ability to adjust the face rest 10 at an incline to the support 12 allows the user to position his head at some angle other than strictly in parallel alignment with the shoulders. Such an inclined position may be more comfortable for the user's head and neck and/or may enable the massage giver to massage certain neck, shoulder and back muscles more effectively.

Figure 5:
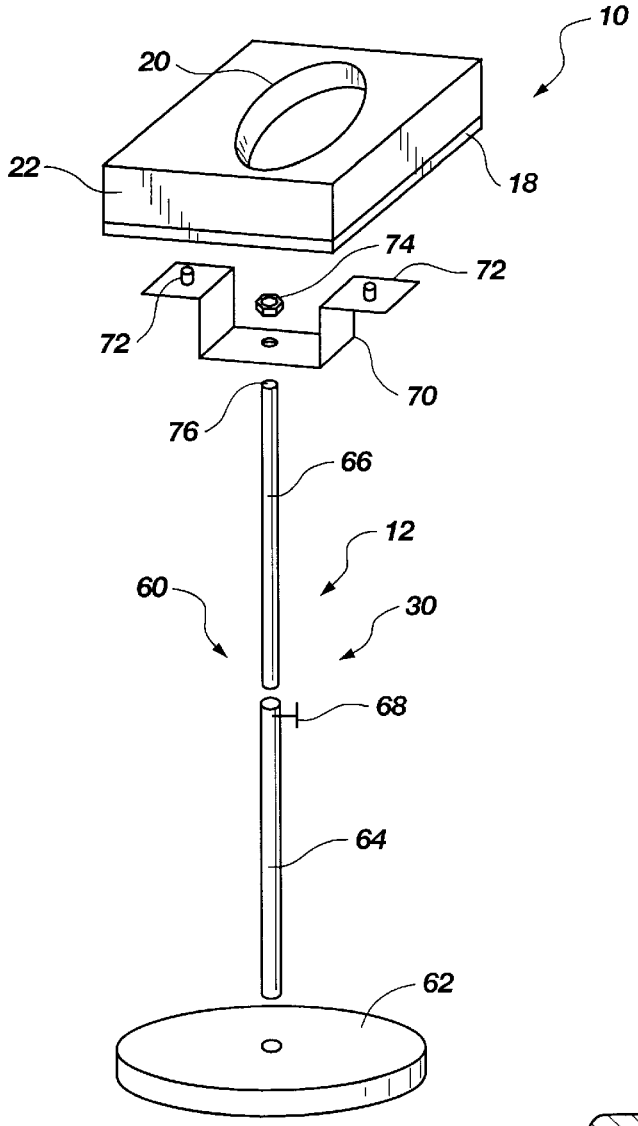
FIG. 5 is an exploded perspective view of an alternative embodiment of the present invention.
Figure 6:
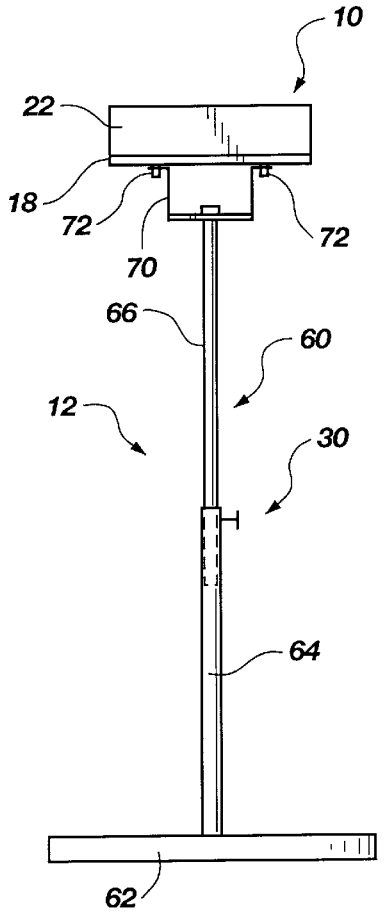
FIG. 6 is a side view in elevation of the embodiment of the invention shown in FIG. 5.

In an alternative embodiment of the invention, shown in FIGS. 5 and 6, the face rest 10 is attached to a support 12 which is in the form of a substantially vertical stand 60 having a base 62 for positioning on a horizontal surface, such as a floor or table. The stand 60 may preferably be longitudinally adjustable to selectively position the face rest 10 at a desired distance or height from the base 62. By way of example only, the adjustable stand 60 illustrated in FIGS. 5 and 6 may comprise a first hollow tube 64, which is permanently or detachably attached to the base 62, and a second tube 66 which is sized to be slidably receivable into the first hollow tube 64. The second tube 66 may, therefore, be positioned at any number of longitudinal positions relative to the first hollow tube 64, and may be secured at a selected position by an adjustment apparatus 30, such as a threaded shank with handle 68 which, when turned, tightens in a biased fashion against the second tube 66. Any suitable device may be used, however, to secure the second tube 66 relative to the first tube 64.

The face rest 10 may be attached to the stand 60 by any suitable means, such as a bracket 70 which attaches, such as by screws or bolts 72, to the base frame 18 of the face rest 10. The bracket 70 may also be permanently attached to the stand 60 or, as shown, may be detachably attached to the stand 60 by a nut 74 which engages a threaded end 76 of the second tube 66. Any other suitable means of attaching the face rest 10 to the stand 60 may be employed. The detachability of the face rest 10 from the stand 60 and the detachability of the first hollow tube 64 form the base 62 facilitates portability.

Figure 7:
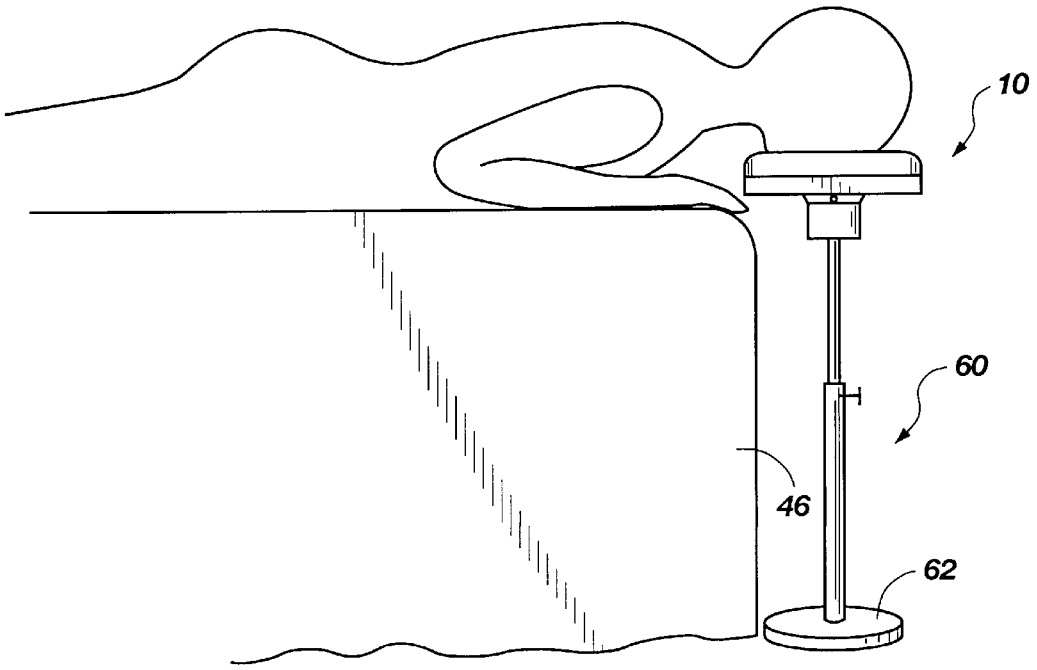
FIG. 7 is a side view in elevation of the alternative embodiment shown in FIG. 6 when in use.

In use, the embodiment of the invention shown in FIGS. 5 and 6 may be positioned, for example, at the edge of a bed 46 or table on which the massage recipient is positioned in a reclining position, as shown in FIG. 7. The massage recipient places his face in the cushioned opening of the face rest 10 while receiving the massage. The face rest 10 can, therefore, be adjusted in height relative to the bed or table to accommodate and support the user's head. While the embodiment of the invention is shown in FIG. 7 as being supported on the floor, the invention may also be structured with a shorter stand 60 (e.g., three to twelve inches in height) which enables the base 62 to be placed on a desk top or table. Thus, in use, the massage recipient may sit in a chair or on a stool, facing the desk or table, and position his head and face in the cushioned opening of a face rest 10 which is supported on the desk or table top.

Figure 8:
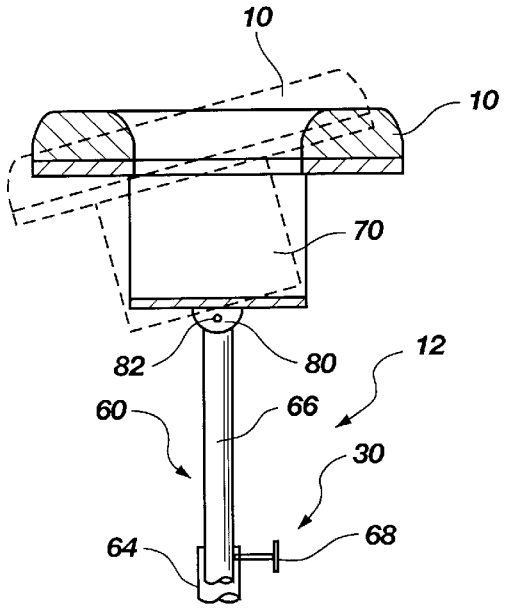
FIG. 8 is a view in cross section of an alternative embodiment of the invention shown in FIG. 6 where the face rest is structured to be adjustably rotatable relative to the stand.

In yet another embodiment shown in FIG. 8, the face rest 10 may be attached to the support 12, or stand 60, in a manner which allows the face rest 10 to be selectively adjusted at an angle to the stand 60. Thus, by way of example only, the bracket 70 may be attached to the second tube 66 of the stand 60 by means of a saddle bracket 80 having a pivot pin 82 about which the bracket 70 may pivot relative to the second tube 66. The face rest 10 may then be selectively adjusted at an angle to the stand 60 to accommodate the comfort of the user's face and head.

Figure 9:
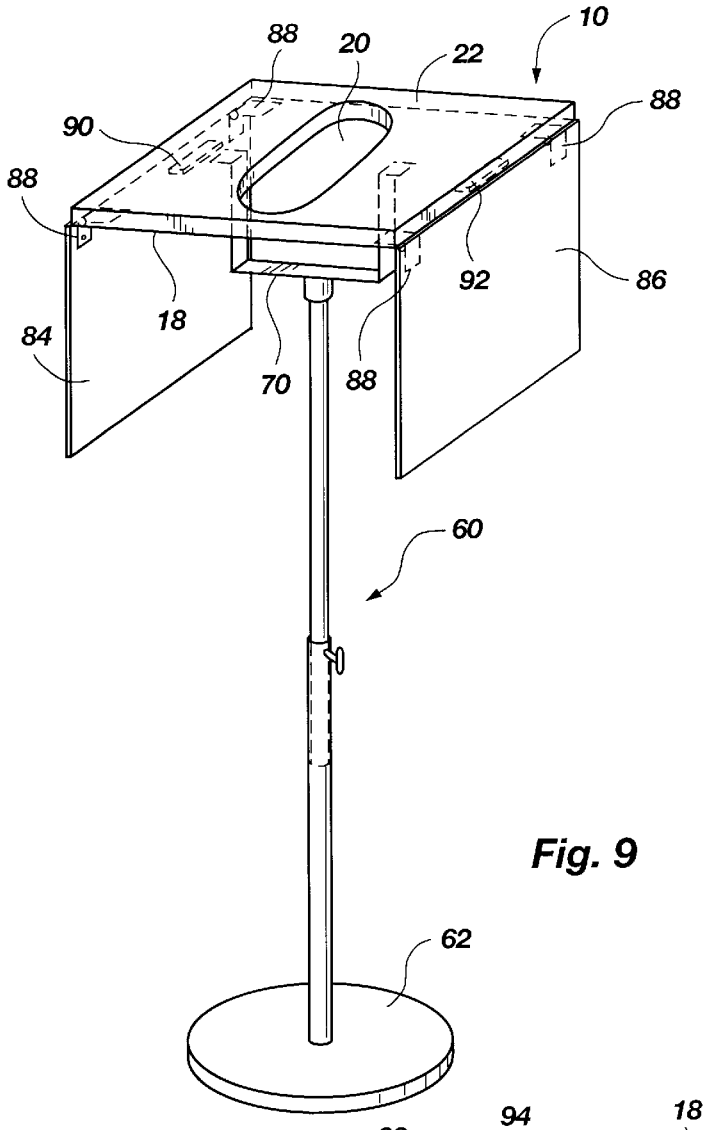
FIG. 9 is a perspective view of another alternative embodiment of the invention shown in FIG. 6 wherein the face rest is structured with adjustable arm rests, shown in a storage position.
Figure 10:
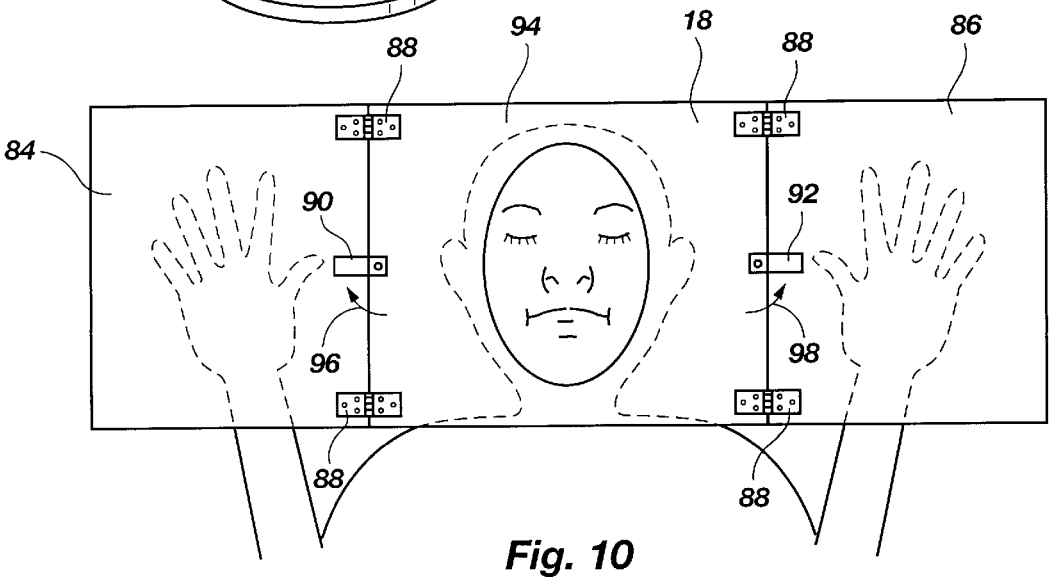
FIG. 10 is a bottom view of the face rest shown in FIG. 9, with the bracket removed to illustrate the arm rests when positioned for use.

In another embodiment of the invention shown in FIGS. 9 and 10, the face rest 10 may be structured with arm rests 84, 86 positioned on, and connected to, opposite sides of the base frame 18 of the face rest 10. The arm rests 84, 86 are preferably attached to the base frame 18 of the face rest 10 in a manner which allows the arms rests 84, 86 to be moved from a first storage position where the arm rests 84, 86 are oriented at a perpendicular angle to the base frame 18 of the face rest 10, as shown in FIG. 9, to a second position where the arm rests 84, 86 are oriented parallel to the base frame 18, as shown in FIG. 10. The arm rests 84, 86 may take any suitable size, form or shape, but are shown in FIGS. 9 and 10 as being planar members attached to the base frame 18 of the face rest 10 by hinges 88 which allow the arm rests 84, 86 to be freely moved relative to the face rest 10. The arm rests 84, 86 may be secured into position parallel to the base frame 18 of the face rest 10 by, for example, the ninety-degree rotation of pegs 90, 92 which are pivotally connected to the underside 94 of the base frame 18. As shown in FIG. 10, the pegs 90, 92 may be rotated outwardly, in the direction of arrows 96 and 98, respectively, to support the arm rests 84, 86 in parallel orientation to the face rest 10. In use, the arm rests 84, 86 are brought into parallel orientation with the face rest 10, as shown in FIG. 10, and the user may place his hands and/or arms on the arm rests 84, 86 during the massage.

The face rest of the present invention is particularly structured to be portable and easily adapted for use in the home or office in giving or receiving a massage. The face rest of the invention is preferably adjustable to accommodate the individual needs of each user and the situation in which the invention is employed to provide the massage. Hence, reference herein to specific details of the illustrated embodiments is by way of example and not by way of limitation. It will be apparent to those skilled in the art that many modifications of the basic illustrated embodiments may be made without departing from the spirit and scope of the invention as recited by the claims.

What is claimed is:

1. A device for supporting the face and head during massage or similar manipulation comprising:

a face rest having a base frame formed with an aperture sized to receive the forward aspect of a user's face and a cushioned member surrounding said aperture;

a slidable support having a longitudinal axis and being connected to said face rest for supporting and selectively positioning said face rest in the direction of said longitudinal axis in relation to a supporting surface; and adjustment apparatus connected to said slidable support for adjusting in the direction of said longitudinal axis a relative distance between a position of the entire face rest and the supporting surface.

2. The device of claim 1 wherein said support further comprises an elongated platform member sized to receive at least a portion of the user's body in a reclining position.

3. The device of claim 2 wherein said elongated platform member is padded.

4. The device of claim 2 wherein said adjustment apparatus includes structure for adjusting said face rest along a longitudinal axis relative to said elongated platform member.

5. The device of claim 4 wherein said elongated platform member is structured with at least one opening sized to slidably receive a stabilizing rod attached to said face rest.

6. The device of claim 2 wherein said adjustment apparatus includes rotatable structure for facilitating movement of said face rest to an angled position relative to said support.

7. The device of claim 4 wherein said adjustment apparatus further includes rotatable structure for facilitating movement of said face rest to an angled position relative to said support.

8. The device of claim 1 wherein said slidable support comprises a substantially vertical stand extending in a perpendicular orientation to said face rest and having a base for supporting said face rest on a supporting surface.

9. The device of claim 8 wherein said stand is comprised of a first hollow tube sized to slidably receive a second tube, and wherein said adjustment apparatus is positioned at said first hollow tube to secure said second tube at a selected position relative to said first hollow tube.

10. The device of claim 9 wherein said stand further comprises a bracket attached to said face rest securing said face rest to said stand.

11. The device of claim 8 wherein said face rest is attached to said stand by rotatable adjustment means which provides rotational movement of said face rest relative to said stand.

12. The device of claim 11 further comprising arm rests positioned on opposing sides of said face rest.

13. The device of claim 12 wherein said arm rests are selectively positionable from a first storage position to a second position for supporting the user's arms.

14. The device of claim 8 further comprising arm rests positioned on opposing sides of said face rest.

15. The device of claim 14 wherein said arm rests are selectively positionable from a first storage position to a second position for supporting the user's arms.

* * * * *